United States Patent [19]

Wood et al.

[11] 4,134,822

[45] Jan. 16, 1979

[54] PROCESS FOR MINIMIZING VAPORIZABLE CATALYST REQUIREMENTS FOR COAL HYDROGENATION-LIQUEFACTION

[75] Inventors: Ralph E. Wood, St. Orem; Wendell H. Wiser, Kaysville; Larry L. Anderson; Alex G. Oblad, both of Salt Lake City, all of Utah

[73] Assignee: University of Utah, Salt Lake City, Utah

[21] Appl. No.: 756,306

[22] Filed: Jan. 3, 1977

[51] Int. Cl.[2] ..... C10G 1/08

[52] U.S. Cl. ..... 208/10

[58] Field of Search ..... 208/9, 10

[56] References Cited

U.S. PATENT DOCUMENTS

| | | | |
|---|---|---|---|
| 3,355,376 | 11/1967 | Gorin et al. | 208/10 |
| 3,668,109 | 6/1972 | Kiovsky et al. | 208/10 |
| 3,764,515 | 10/1973 | Kiovsky | 208/10 |
| 3,775,286 | 11/1973 | Mukherjee et al. | 208/10 |

OTHER PUBLICATIONS

Anderson, Wood, & Wiser "Clean Energy from Coal" pp. 318–321, Society of Mining Engrs, Aime Transactions vol. 260, Dec., 1976.

Wood, Wiser "Coal Liquefaction in Coiled Tube Reactors" Ind. Eng. Chem. Process Devel., vol. 15, No. 1, 1976, pp. 144–149.

*Primary Examiner*—Delbert E. Gantz
*Assistant Examiner*—Joan Thierstein
*Attorney, Agent, or Firm*—Criddle, Thorpe & Western

[57] ABSTRACT

A process for reducing the amount of catalyst required for coal hydrogenation-liquefaction reactions involving dry fed, short-residence coal reaction systems. Coal particles are mixed with dry catalyst material having a vapor pressure of 1 to 1000 mm Hg at reaction conditions. Catalysts having such high vapor pressure have demonstrated greatly improved ability to establish the required intimate contact for efficient catalysis when dry mixed and enable significant reduction of amounts of catalyst material required. In systems utilizing $ZnCl_2$ as the catalyst material, reductions in percent weight concentration to the range of 1 to 2% are accomplished.

The invention disclosed herein was developed in part under contract funding provided by the Energy Research and Development Administration of the United States Government.

7 Claims, 2 Drawing Figures

PROCESS FOR MINIMIZING VAPORIZABLE CATALYST REQUIREMENTS FOR COAL HYDROGENATION-LIQUEFACTION

BACKGROUND OF THE INVENTION

1. Field of Invention

The present invention relates to improved catalysis in coal liquefaction processes.

2. Prior Art

The extensive coal reserves of the United States provide a potentially vast source of petrochemical energy, provided their conversion to a usable form can be economically accomplished. A substantial amount of government funded research has been directed toward commercial processes for both gasification and liquefaction of coal; however, the high costs of such processes still remain a primary deterrent to the utilization of this abundant source of energy.

With respect to the field of coal liquefaction, numerous techniques have been developed, including (1) gasification to CO and $H_2$ followed by synthesis to liquid hydrocarbons, (2) carbonization, (3) hydrogenation of coal-oil slurry, and (4) dry coal hydrogenation. A major difficulty with all these processes is the minimizing of energy consumed to effect the conversion process. To reduce reaction time and accomplish the reaction at lower temperature, a catalyst is customarily involved at some point in most liquefaction methods.

The selection of a particular catalyst depends upon the nature of the reaction conditions, viewed in relation to previous catalyst experience derived from a trial and error approach. In the absence of conclusive theoretical basis, the current problem solving process associated with catalyst selection has developed into a unique art which continues to rely in part on a trial and error process. This lack of understanding has resulted in the random identification of specific compounds which have experimentally demonstrated some utility as hydrogenating catalysts without sufficient theoretical understanding to maximize their efficiency. A partial list of such identified catalysts is disclosed in Anderson, Wood, and Wiser, "Clean Liquid Energy from Coal", Society of Mining Engineers of AIME, Preprint No. 75-F-318 (1975).

Heretofore the choice of catalyst and method of application in coal hydrogenation has not been based on any common unique physical properties associated with the identified catalysts. Because of the lack of such common properties, a class definition has been limited to those compounds which provide the chemical result of effective hydrogenation under specified reaction conditions. Such a definition is of little assistance in improving current catalysis methods and searching for new materials.

The techniques of coal liquefaction catalysis have been varied. In 1968 the Office of Coal Research completed an extensive study in which molten $ZnCl_2$ in large concentrations was investigated as a catalysis environment. United States Department of Interior, OCR Research and Development Report No. 39, Vol. III, Book 1, "Research on Zinc Chloride Catalyst for Converting Coal to Gasoline." Unfortunately, the process did not prove to be economically feasible. The high energy cost of maintaining the $ZnCl_2$ in melt form and the catalyst loss associated with the process involve costs beyond that which the market would endure.

In a series of U.S. patents relating to dry coal processing (U.S. Pat. Nos. 3,152,063; 3,823,084; 3,926,775; and 3,944,480) Schroeder discusses the use of catalysts selected from those known in the art, namely tungsten or molybdenum oxides or sulfides, tin or iron group metals such as iron, nickel, cobalt and their compounds. The suggested means of applying the catalyst in the first patents was by impregnation of the catalyst on the surface of the coal particles by means of a slurry of catalyst in solution. The latter patents disclose the use of catalyst bed reactions wherein the coal particles are carried through the catalyst bed by means of a stream of hydrogen gas.

Attempts to apply the teachings of these patents and other prior art related to coal hydrogenation-liquefaction have failed to meet the requirements for an economical system. Utilizing small tube diameter reactor systems, the present inventors evaluated the respective catalysts shown below under reaction conditions of 650° C. and $H_2$ pressure of 1750 psi and flow rate of 3.5 standard cubic feet per minute:

| Catalyst | Coal Conversion % |
|---|---|
| $ZnBr_2$ | 58.5 |
| $ZnI_2$ | 46.3 |
| $ZnCl_2$ | 41.1 |
| $SnCl_2 . 2H_2O$ | 40.5 |
| $SnCl_4 . 5H_2O$ | 25.6 |
| LiI | 16.6 |
| $CrCl_2$ | 12.8 |
| $Pb(C_2H_3O_2)_2 . 3H_2O$ | 11.7 |
| $NH_4Cl$ | 11.0 |
| $CdCl_2 . 5H_2O$ | 7.9 |
| Sn (powder) | 7.9 |
| $CnCl_2 . 2H_2O$ | 7.6 |
| $FeCl_3 . 6H_2O$ | 7.2 |
| Zn (powder) | 7.0 |
| $ZnSO_4 . 7H_2O$ | 5.4 |
| $(NH_4)_6 Mo_7O_{24} . 4H_2O$ | 5.4 |
| $FeCl_2$ | 3.3 |
| $CaCl_2 . H_2O$ | no reaction |
| $Na_2CO_3 . H_2O$ | no reaction |

As a result of this evaluation it was discovered that most of the catalysts suggested in the Schroeder patents failed to produce sufficient conversion yield to offset the costs of catalyst replenishment and recovery. Of the remaining catalysts which reflect the higher percents of conversion, the requirements of using in excess of 5 to 10% catalyst lead to increased cost due to their expensive character and difficulties in catalyst recovery. In addition, the application of prior art teachings relating to catalyst impregnation by means of a slurry coating followed by drying, would cause increased energy losses. Essentially, the prior art remains encumbered by the recurring economic obstacle of a noncompetitive position with respect to crude oil imports, suggesting the need for a new approach to the catalysis step in coal liquefaction.

OBJECTIVES AND INVENTION SUMMARY

It is an objective of the present invention to define a class of catalysts useful in coal hydrogenation-liquefaction having a common physical property of high vapor pressure.

It is a further object of this invention to provide an improved method of exposing catalyst material to molecular level contact with coal.

It is an additional object of the present invention to provide a method of catalysis of coal hydrogenation which minimizes or eliminates the need to recover the catalyst material utilized.

A decrease in catalyst concentration for coal hydrogenation-liquefaction processes is accomplished by utilizing metallic salts having hydrogenating ability and a vapor pressure in the range of 1 to 1000 mm Hg at reaction conditions. The high vapor pressure of such catalysts improves the intimate molecular contact between the coal and catalyst materials and thereby increases the efficiency of the liquefaction process. Catalyst recovery procedures are consequently minimized, further reducing the economic costs which have impeded commercialization of dry-fed coal liquefaction processes. An improved method is disclosed for exposing such catalysts to the particulate coal by a dry mixing procedure which operates to reduce energy consumption during the process and improve efficiency of catalysis.

DETAILED DESCRIPTION

The present invention is particularly related to hydrogenation-liquefaction reactions utilizing coal which is dry-fed to a short residence reaction zone. In such processes involving a reaction period of less than two minutes, small variations in reaction constituents and conditions have demonstrated a profound economic effect upon the commercial utility of the process. The subject invention is directed to improving catalysis procedures and thereby maximizing synthetic oil production at minimal cost.

Although the mechanism for the catalysis of the hydrogenation-liquefaction reaction has not been confirmed, a critical factor to an efficient process involves a requirement for intimate contact on a molecular scale between the coal and catalyst materials. This intimate contact may be established by breaking down either the particulate coal or catalyst to a molecular scale and bringing both materials into maximum physical contact.

The present invention relies on the physical property of a high vapor pressure catalyst to develop the molecular scale environment in the reaction temperature range and thereby accomplish the required intimate contact. It has been discovered that by using such catalysts, the need for dissolving catalyst material into solution and then coating the coal with the solution is obviated. The result is that the catalyst dissolving and drying steps of the liquefaction process are eliminated, thereby saving energy and promoting economy.

Figure 2:
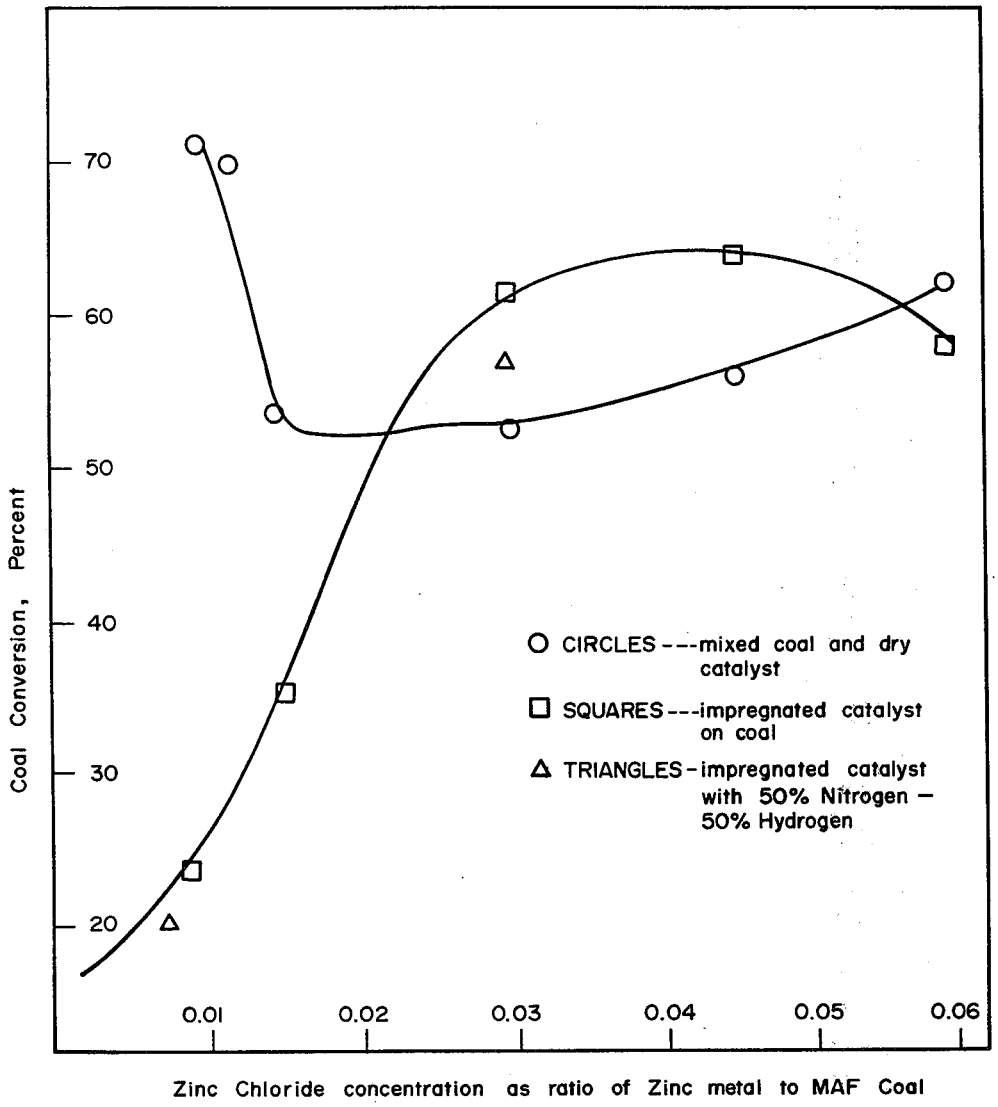
FIG. 2 is a graph demonstrating the unexpected increase in coal conversion by dry mixed catalysts and coal solids versus impregnated catalyst mixtures of conventional means.

Referring to FIG. 2, it will be noted that a decreasing concentration of impregnated $ZnCl_2$ catalyst from about 5% results in a dramatically attenuated rate of coal conversion. Impregnation in this case involves the previously explained conventional procedure of dissolving the catalyst to form a solution and then coating the coal with this solution and allowing the material to dry. The impregnation data of FIG. 2 suggest that the optimum concentration for $ZnCl_2$ should be about 5% by weight.

It has now been discovered that this technique of solution coating does not operate as effectively as simply mixing lower concentrations of less than 5 weight percent dry catalyst with the particulate coal. As reflected by the curve defined by the circle points in FIG. 2, a dry coating procedure has the surprising effect of yielding an increased percent coal conversion in the range of catalyst concentration of about 2% and less, and particularly at less than 1.5 weight percent, despite the opposite trend of solution coated reactions in this same range.

It appears that this unique character is related to the higher vapor pressure of certain hydrogenation catalysts which achieve the required intimate contact between coal and catalyst by virtue of the molecular diffusion of the catalyst vapor. For reasons which are not fully understood, these catalyst materials appear to spread more uniformly over internal coal surfaces by vapor diffusion during the reaction when the initial coating is accomplished by dry mixing rather than solution coating. These data points have been confirmed in experiments using finely ground zinc chloride which was mixed with coal particles and then brought to reaction temperatures--450° C. to 600° C. It has been demonstrated that other hydrogenating catalysts which have similar vapor pressures to that of zinc chloride (100 mm Hg at reaction conditions) would also operate more effectively under this procedure.

Figure 1:
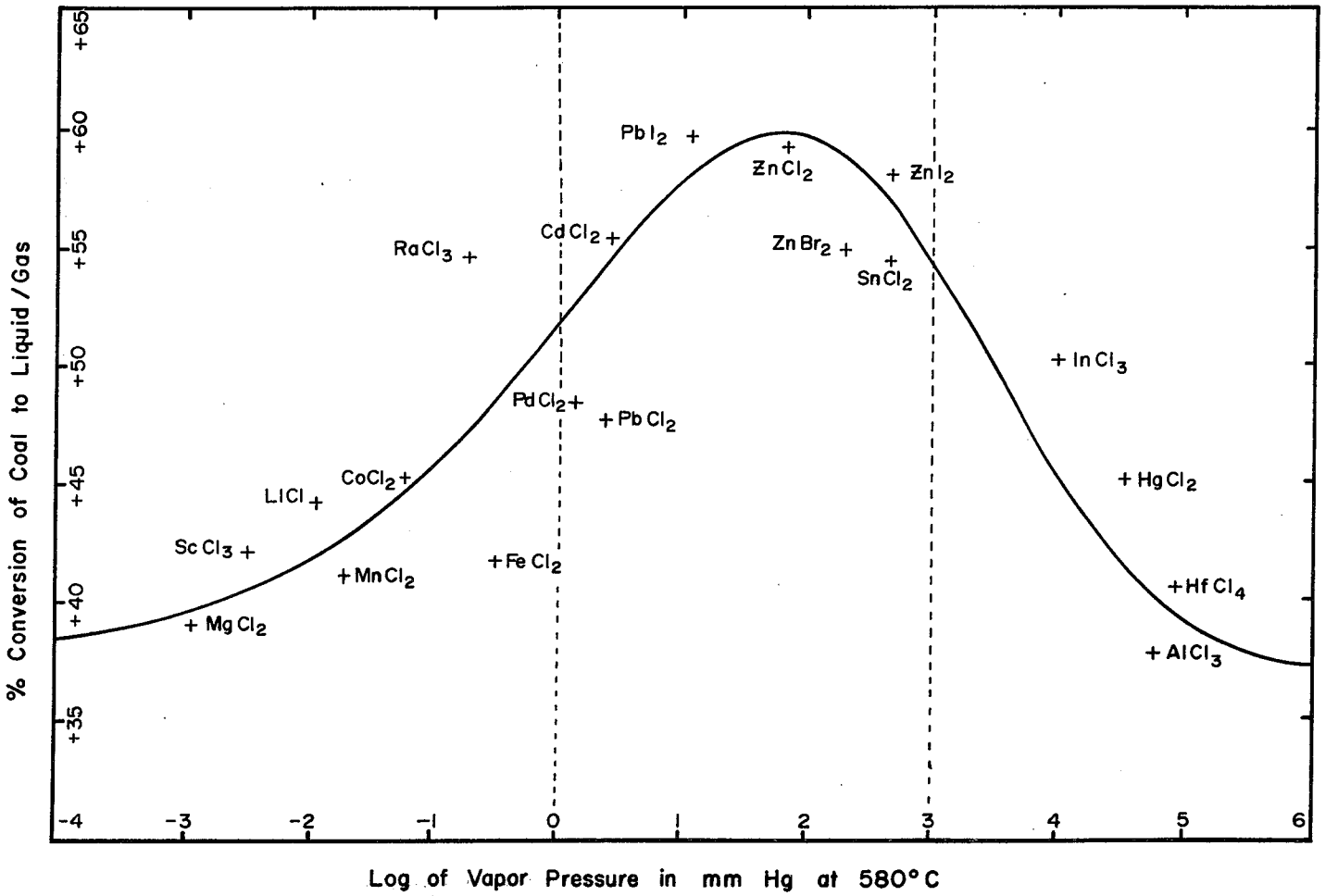
FIG. 1 is a graphic display of vapor pressure versus coal conversion ability for numerous metallic salts. The peaked region portrays the effectiveness of metallic salts which have the dual character of hydrogenating catalysts and high vapor pressure properties.

FIG. 1 represents a graphic illustration of potential catalysts within this class of high vapor pressure, hydrogenating compounds. These compounds are part of the general class of catalysts taken from the generic group identified as metallic salts which act as hydrogenating catalysts. The preferred range of vapor pressure levels spans from approximately 1 mm to 1000 mm Hg at 580° C. It should be noted that the defined class of dry-mix catalysts requires the concurrent occurrence of both conditions of (1) hydrogenating character and (2) high vapor pressure at reaction conditions. A vapor pressure without hydrogenating ability is ineffective in a coal liquefaction process, i.e. $HgCl_2$, $HfCl_4$ and $AlCl_3$.

With respect to the method of mixing the dry catalyst and coal materials prior to reaction, any conventional techniques which would provide for uniform mixing of powdered catalyst and coal would suffice. Additional catalyst reduction can be achieved by a procedure involving a first step of mixing a small amount of catalyst (less than 1%) with the coal, followed by injection of catalyst vapor at appropriate sites along the reactor.

It also appears that the subject liquefaction reaction can be maintained by exposing the particulate coal to catalyst vapors of the defined class of compounds without the concurrent dry mixing procedure. An example of such an arrangement would comprise a coal transport system within a reaction chamber, said chamber also having appropriately arranged inlet ducts for feeding catalyst vapor to the coal. The vapor source could be in the form of a catalyst bed maintained at a temperature consistent with the evolution of sufficient catalyst vapor to enable regulation of the vapor injection at the inlet ducts.

The primary value of incorporating the principles of vapor catalysts to coal hydrogenation-liquefaction is the reduction of catalyst material requirements and simplifying catalyst recovery. At an application rate of 5.5% $ZnCl_2$ for example, without recovery, the approximate attributable catalyst cost is $44.00 per ton of coal. Since the current costs of coal are about $22.00 per ton, the catalyst expense is twice as high as the cost of the material to be catalyzed. At such concentrations, recovery of the catalyst is a critical step if the process is to operate economically. Assuming a production rate of 2.5 barrels of synthetic crude oil per ton of coal, an increase in recovery of $ZnCl_2$ from 95% to 99% represents a per barrel catalyst cost reduction of 78% from $0.90 to 0.20 per barrel.

At catalyst concentrations greater than 5% weight percent $ZnCl_2$, essentially all the catalyst must be recovered to avoid excessive production costs. In this concentration range, the recovery procedure requires the addition of a difficult acid wash step to complete recovery after the conventional water wash procedure. Reduction of $ZnCl_2$ concentration to approximately 1 weight percent would eliminate the need for an acid wash, thereby providing a substantial reduction in cost. The utility of the procedures outlined herein have been experimentally confirmed in this range of catalyst application.

Additional research indicates that small applications of $ZnCl_2$ to coal induces a significant expansion of the pore structure of coal when subjected to temperatures in the range of coal liquefaction. Such a change in the coal structure prior to hydrogenation may reduce the tendency of $ZnCl_2$ to be trapped in the char structure and thereby improve recovery of catalyst by water leaching. For a more detailed discussion of catalyst recovery and hydrogenation-liquefaction procedures, reference is made to Wood and Wiser, "Coal Liquefaction in Coiled Tube Reactors," I & EC Process Design and Development, Vol. 15, p. 144, January 1976.

We claim:

1. In a process for catalytic hydrogenation-liquefaction of dry-fed coal under short-residence reaction environment conditions, an improved catalyzing procedure comprising the steps of:

(a) selecting a catalyst material from a group of compounds comprised of metallic salts having hydrogenating character and having a vapor pressure in the range of 1 mm to $10^3$ mm Hg at reaction temperatures, and (b) applying an amount of dry catalyst less than 5 weight percent based on total weight of coal and catalyst to said coal in sufficient time prior to removal of said coal from the reaction environment to obtain a desired level of reaction.

2. A process as defined in claim 1, wherein said applying step comprises the step of mixing the dry coal with particulate catalyst prior to introducing the combination into a reaction zone.

3. A process as defined in claim 1, wherein said applying step comprises exposing the dry coal to catalyst vapor generated from said dry catalyst without physically contacting the coal with particulate catalyst material.

4. A process as defined in claim 1, wherein the applying step comprises the steps of mixing the dry coal with particulate catalyst prior to introducing the combination into a reaction zone and further subjecting said coal-catalyst mixture to additional catalyst vapor introduced by means which maintain an absence of particle contact between said mixture and the catalyst vapor source, the total concentration of applied catalyst being less than said 5 weight percent.

5. A process as defined in claim 1 wherein the metallic salts are selected from the group consisting of $ZnCl_2$, $SnCl_2$, $ZnBr_2$, $ZnI_2$, $PbI_2$ and $PbCl_2$.

6. A process as defined in claim 1, wherein an amount of catalyst less than 1.5 weight percent based on total weight of coal and catalyst is used and further comprising the step of recovering the catalyst after reaction by a water wash.

7. A process as defined in claim 6, wherein the catalyst is $ZnCl_2$.

* * * * *